United States Patent [19]

Browning

[11] 4,312,084

[45] Jan. 26, 1982

[54] INFLATABLE BATHTUB FOR BEDRIDDEN PATIENTS

[76] Inventor: Robert K. Browning, 4101 Royalview Dr., Knoxville, Tenn. 37921

[21] Appl. No.: 98,919

[22] Filed: Nov. 30, 1979

[51] Int. Cl.[3] ..... A47K 3/06; A47K 3/14; A47K 3/162

[52] U.S. Cl. ..... 4/538; 4/547; 4/555; 4/558; 4/585; 4/592

[58] Field of Search ..... 4/448, 452, 463, 534, 4/544, 547, 585, 588, 538, 540, 542, 567, 580, 584, 659, 447, 456, 488, 506, 546, 548, 555, 556, 558, 559, 571, 573, 587, 592, 593, 655, 660; 5/90, 98 R, 449; D23/52; 128/369; D24/38; D21/237

[56] References Cited

U.S. PATENT DOCUMENTS

| | | | |
|---|---|---|---|
| 29,914 | 9/1860 | Ramsay et al. | 4/585 |
| 88,054 | 3/1869 | McCully | 4/580 |
| 455,429 | 7/1891 | McDonald | 4/580 |
| 568,811 | 10/1896 | Stoll | 4/585 |
| 573,625 | 12/1896 | Ruffner | 4/588 |
| 1,454,112 | 5/1923 | Graves | 4/571 |
| 2,432,147 | 12/1947 | Freund | 4/547 X |
| 2,471,302 | 5/1949 | Boward | 4/588 |
| 2,483,789 | 10/1949 | Smith et al. | 4/585 X |
| 2,504,646 | 4/1950 | Burrow | 4/588 |
| 2,763,873 | 9/1956 | Saunders | 4/588 |
| 3,058,122 | 10/1962 | McDaniel et al. | 4/588 X |
| 3,681,789 | 8/1972 | Bott | 4/588 |
| 3,755,830 | 9/1973 | Johns | 4/585 |
| 3,803,642 | 4/1974 | Erling et al. | 4/587 |
| 3,938,200 | 2/1976 | Roberts et al. | 4/580 |
| 4,000,742 | 1/1977 | DiGiacomo | 4/448 X |
| 4,003,098 | 1/1977 | Fink | 5/98 R X |
| 4,068,326 | 1/1978 | Deschler | 4/588 X |

*Primary Examiner*—Stuart S. Levy
*Attorney, Agent, or Firm*—Pitts & Kesterson

[57] ABSTRACT

This invention involves a new and unique inflatable bathtub for bedridden patients. More particularly, the bathtub includes a thin pliable sheet such as vinyl, which may be disposed of after one or more uses. The pliable sheet has a multiplicity of the first portion of attaching members located around the peripheral of the pliable sheet. In a preferred embodiment, these first portions of the attaching members are simply apertures around the peripheral of the pliable sheet. The pliable sheet is placed under the patient in the well-known manner of changing bed sheets while the patient remains in the bed. An inflatable rim member made of heavy-duty material and having the cooperating second portion of the attaching members is then placed around the patient. The second portion of the attaching members may simply be hooks which cooperate with the multiplicity of apertures. The multiplicity of apertures of the pliable sheet are then joined to the attaching hooks of the inflatable rim member, and the rim member is then inflated to created a water impervious container surrounding the patient. In a preferred embodiment, the rim member is an inflatable linear member which can be curved around the patient and which has attaching means located at each end. This embodiment is particularly suitable for patients in traction, or for patients where movement is very painfully and must be kept to a minimum. Thus, for storage, the linear member and inflatable rim may be rolled or folded, and when needed for use, the member is unrolled, curved around the patient and then joined together at its two ends to form a ring or rim surrounding the patient. The invention further includes a combination spray and suction drainage system.

6 Claims, 7 Drawing Figures

INFLATABLE BATHTUB FOR BEDRIDDEN PATIENTS

BACKGROUND OF THE INVENTION

This inventions relates to inflatable water impervious containers, and more particularly to inflatable bathtubs for bedridden patients. The invention is especially suitable for patients in traction, or for those patients where the minimum movement and rolling of the patients body is desired.

Various types of portable bathtubs have been proposed for use by the prior art. For example, a very early bathtub described in U.S. Pat. No. 29,914 and issued to Ramsay and Wilson in September 1860 was made of India Rubber and included a metal framework for support. In addition, various inflatable bathtubs for invalids have also been proposed. As examples, U.S. Pat. No. 573,625 issued to M. O. Ruffner on Dec. 22, 1896 for an "Invalid's Bathtub". According to this patent, there is disclosed a rubber structure which when inflated takes on a basic bathtub shape suitable for bathing a bedridden patient. The structure including means for inflating the tub and means for draining off any collected water. Two very similar inflatable bathtubs are disclosed in U.S. Pat. No. 2,471,302 issued to N. M. Boward on May 24, 1949 and U.S. Pat. No. 2,504,646 issued to M. B. Burrow on Apr. 18, 1950. In addition to the tub itself, the Boward patent describes a portable auxiliary cart and various air and water interconnecting facilities. The Burrow patent includes double-layered portions in the bottom of the tub for providing pillow or cushion means to the patient. U.S. Pat. No. 2,432,147 issued to R. R. Freund on Dec. 9, 1947 is also similar except it is for use with special beds having toilet facilities built into the bed. According to this patent, the drain of the portable bathtub is over the included toilet facilities.

Still another inflatable bathtub similar to those heretofore discussed is disclosed in U.S. Pat. No. 3,058,122 issued to B. B. McDaniel et. al., on Oct. 16, 1962. This bathtub is similar to those just discussed, except it is made of a thermo plastic film to keep the cost low, and is intended for use in emergency situations where there are a large number of victims suffering from radioactive or radiation burns.

Still two other inflatable bathtubs discussed in the prior art include those disclosed in the U.S. Pat. No. 3,681,789 issued to E. Bott on Aug. 8, 1972 and U.S. Pat. No. 4,068,326 issued on Jan. 17, 1978. These two patent which are similar to those previously discussed describe auxiliary equipment for use with an inflatable bathtub including an attached cover, holding or restraining straps, and a water heater unit.

In addition to the inflatable bathtub disclosed in the afore mentioned patents, other portable tubs for use in hospitals are available. For example, Porta-Tub made by Mediglas, Inc. of Charlotte, N. C. sells a self-contained bed level fiberglass bathtub which is supported on heavy-duty coasters. This tub is rolled up to the patient's bed and the patient is then transferred from the bed into the tub. A spray means and suitable drainage is also provided.

It will be apparent, that the Porta-Tub is fine for bedridden patients who are not extremely overweight or for those patients where movement of the patient is merely inconvenient and not painful or undesirable.

However, such a bathtub cannot be used by severely injured or bedridden patients in traction.

For seriously injured patients for which movement must be kept to an absolute minimum, the inflatable tubs heretofore discussed do provide some answers. Unfortunately, even though most of the prior art inflatable tubs attempt to keep the uninflatable bulk to a minimum so that it can be rolled under the patient, practice has shown that the supporting inflatable rim which requires considerable structural strength still presents substantial bulk which must be moved under the patient. In addition, these type of inflatable tubs still are very inconvenient or impossible to use with patients in traction.

Because of the sterile conditions that must be maintained in a hospital environment, it is often most desirable to use sterilized equipment which can be disposed of rather than equipment which must continuely be sterilized. In the case of inflatable bathtubs, most suitable rubber or plastic film materials simply cannot tolerate the high temperature steam commonly used in the sterilization procedures. Further, disposal of the entire inflatable tub has been unsatisfactorily because of the cost involved.

SUMMARY

Therefore, it is an object of this invention to provide a portable bathtub having substantially reduced bulk which must be moved under the bedridden patient.

It is still another object of this invention to provide a portable bathtub that provides very sterile conditions.

It is yet another object of this invention to provide a portable bathtub which does not have to be sterilized after each use.

Still another object of this invention is to provide a portable bathtub suitable for use with patients in traction.

It is yet another object of this invention to provide a inexpensive and easily used portable bathtub which can readily be used by one person and requires minimal storage space.

Another object of the invention is to provide a portable tub which can be used without requiring movement of the patient from his bed during the bathing operation thereby enhancing the safety concomitant with bathing.

Other objects and advantages will become apparent upon reading the following detailed description together with the drawings.

Accordingly, these and other object of the present invention are achieved by providing a portable bathtub for bathing bedridden patients as the patient remains in a reclining position or in traction in his bed. A water impervious pliable sheet member includes the first portion of a multiplicity of attaching members located around the peripheral portion of the sheet member. In a preferred embodiment, the first portion of the attaching members are simply apertures in the peripheral of the sheet member. The sheet member is thin and pliable, and is therefore suitable for moving under the bedridden patient as the patient lays in the bed. An inflatable rim member suitable for locating on the bed and surrounding the bedridden patient is also provided. The inflatable rim member includes the second portion of the multiplicity of attaching members suitable for cooperating with the first portion of the attaching members. These attaching members are secured to the top portion of the rim member surrounding the bedridden patient. The first portion of the multiplicity of attaching members on the pliable sheet can be attached to corresponding ones of the second portion of the attaching members on the rim member so that when the rim member surrounding the bedridden patient is inflated, the peripheral portion of the pliable sheet, which is under the bedridden patient, is raised from the surface of the bed such that it produces a water impervious bathtub containing the bedridden patient. In the preferred embodiment, the rim member is linear member which can be curved around the patient. The two ends of the rim member may then be joined. This embodiment is particularly suitable for patients in traction.

DESCRIPTION OF THE INVENTION

Figure 1:
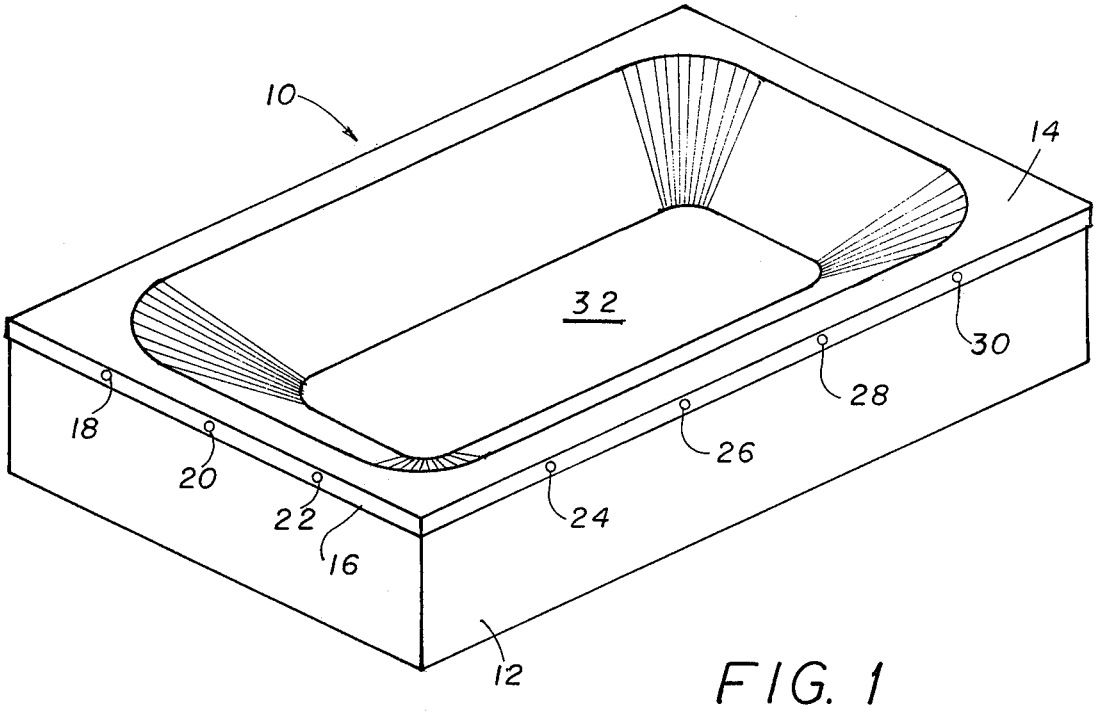
FIG. 1 is a perspective view of the inflatable portable bathtub in its inflatable condition, and shows the pliable sheet and the surrounding inflatable member.

Referring now to FIG. 1, there is shown generally at 10 a perspective view of the portable bathtub of this invention. As is shown, an inflatable rim member 12 provides a support structure to which there is attached a pliable sheet 14. It will be appreciated, that inflatable rim member 12 may be made of any suitable air-tight material such as a rubberized canvas, or a plastic or vinyl film. Other plastic films such as poly-vinyl chloride etc. may also be used as the supporting rim member 12. In a similar manner, the sheet member 14 is preferrably simply a thin pliable vinyl sheet which is water impervious. It has been found that a 5 mil sheet is especially suitable. As shown in FIG. 1, attached to the top side 16 of rim member 12 are attaching means 18, 20, 22, 24, 26, 28 and 30. These attaching means 18 through 30 may be any suitable attaching means as will be discussed hereinafter, but are preferably simply molded vinyl hooks that cooperate with apertures around the peripheral of plastic sheet 14. As shown, plastic sheet 14 is simply stretched over the top portion 16 of rim member 12 and attached thereto by the attaching means 18 through 30. Another suitable means for attaching sheet 14 to rim member 12 is the use of Velcro strips. Although, it may be desirable that plastic sheet 14 include a depression molded therein to establish the well portion 32 in which the bedridden patient lies, such a molded depression is not necessary and it is possible to simply use a large enough pliable sheet 14 such that when the sheet is attached at attaching points 18 through 30, there is enough material to form said depression 32.

Figure 2:
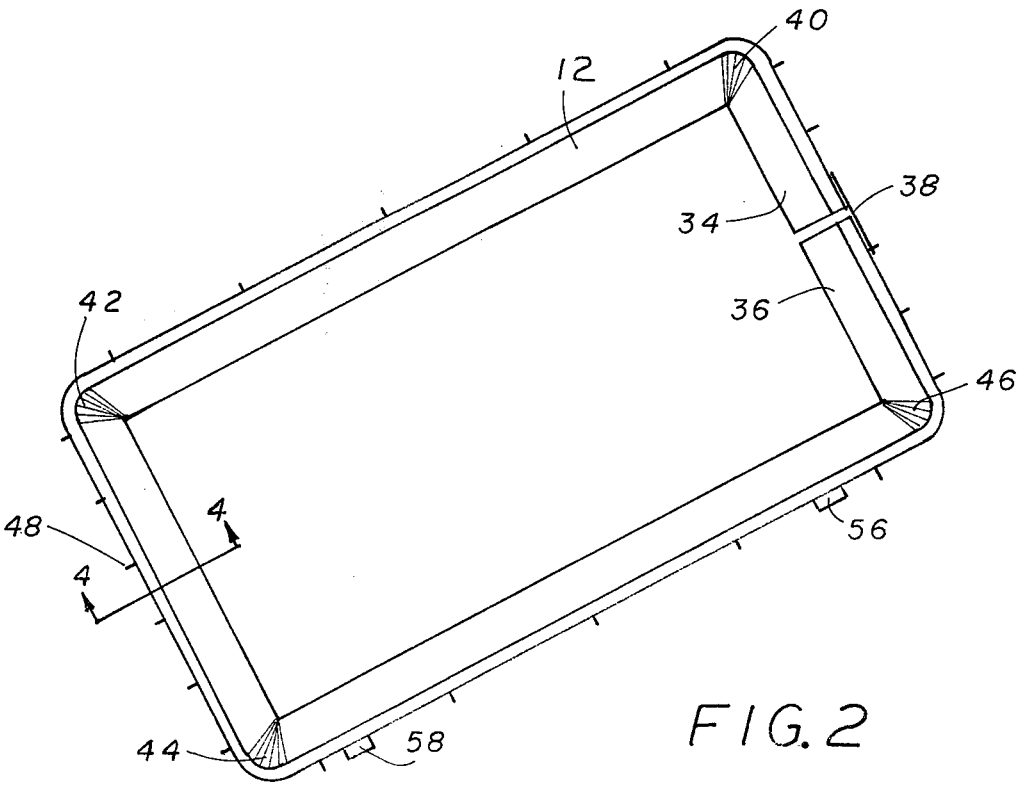
FIG. 2 is a top view of one embodiment of the rim member which is a linear member which closes at its two ends.
Figure 3:
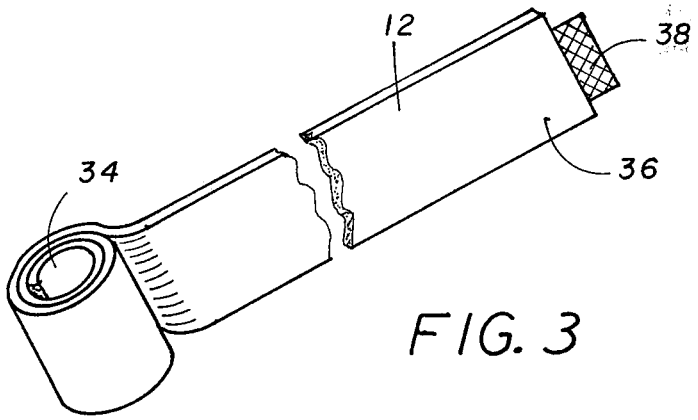
FIG. 3 shows an embodiment of the rim member of FIG. 2 wherein the inflatable rim portion is a linear strip having attaching means at each end and can be rolled or folded.
Figure 4:
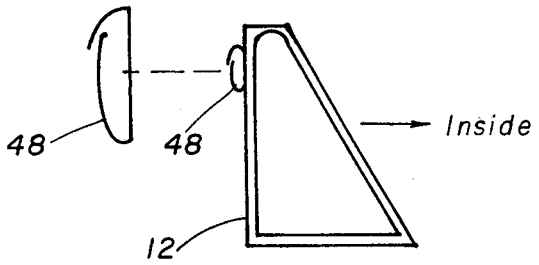
FIG. 4 is a cross-section of the inflatable rim member showing one embodiment of attaching members.

Referring now to FIGS, 2, 3, 4 and 5, there is shown an embodiment of this invention which is particularly suitable for use with patients in traction or those patients for which any movement is particularly painful and which can be readily used by one person. As is shown in the top view of FIG. 2, it is possible to make rim member 12 of a single linearly inflatable member having two ends 34 and 36. The two ends 34 and 36 when in use are joined together by a fastening means 38. Further, it will be appreciated that rim member 12 may include reinforcement areas at the corners 40, 42, 44 and 46 where the linear member 12 has been curved at right angle to surround the bedridden patient. When the linear member 12 is in an uninflated state, it may readily be rolled or folded into a compact unit such as shown in FIG. 3. Thus when ready for use, linear member 12 is simply unrolled or unfolded and placed around the bedridden patient, and the ends 34 and 36 joined by the attaching means 38. Referring now to FIG. 4, there is shown a cross-section of linear member 12 of FIG. 2 taken at cross-section point 4—4 of FIG. 2. As shown in FIG. 2, a series of attaching members such as attaching member 48 are located around the top outside peripheral of the rim member 12. FIG. 4 shows that attaching member 48 may simply be a molded sturdy plastic hook. Further, as will be appreciated by those skilled in the art, any suitable attaching member 38 may be used to join the two ends 34 and 36 to surround the bedridden patient. However, for ease of manufacture and simplicity of operation it has been found that a Velcro strip may be used at the two ends 34 and 36 for attaching purposes.

Figure 5:
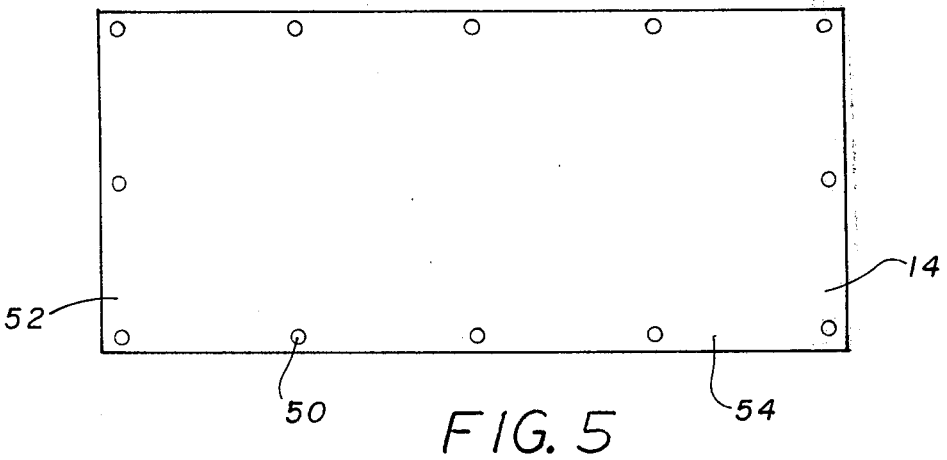
FIG. 5 is a top view of the pliable sheet prior to being attached to the surrounding rim member.

Referring now to FIG. 5, it can be seen that in this preferred embodiment, plyable sheet 14 may simply be a rectangular sheet having a multiplicity of apertures located around the perimeter of the rectangular sheet. It will be appreciated of course, that there may necessarily be the need of a significantly greater number of apertures 50 than are shown in the sheet member 14 of FIG. 5. For example, as shown in FIG. 2 there are at least six attaching hooks similar to attaching hooks 48. Thus, if a sheet similar to that shown in FIG. 5 having apertures around the perimeter is to operate with a rim member 12 such as shown in FIG. 2, then the number of apertures on end 52 as shown in FIG. 5 would necessarily also be six rather than three as shown. Similarly, on the end 54 there would also be additional apertures.

Referring again to FIG. 2, it will be appreciated that rim member 12 may also include attachment points 56 and 58 which are permanentely mounted thereto. These attaching points may be used for any suitable purpose, but are particularly suitable for storing a spray or aspirator apparatus to be discussed hereinafter. Thus, it will be appreciated that there has been described to this point apparatus including a rim member 12 and a pliable sheet member 14 which may be made to cooperate together to provide the portable bathtub of this invention.

Figure 6:
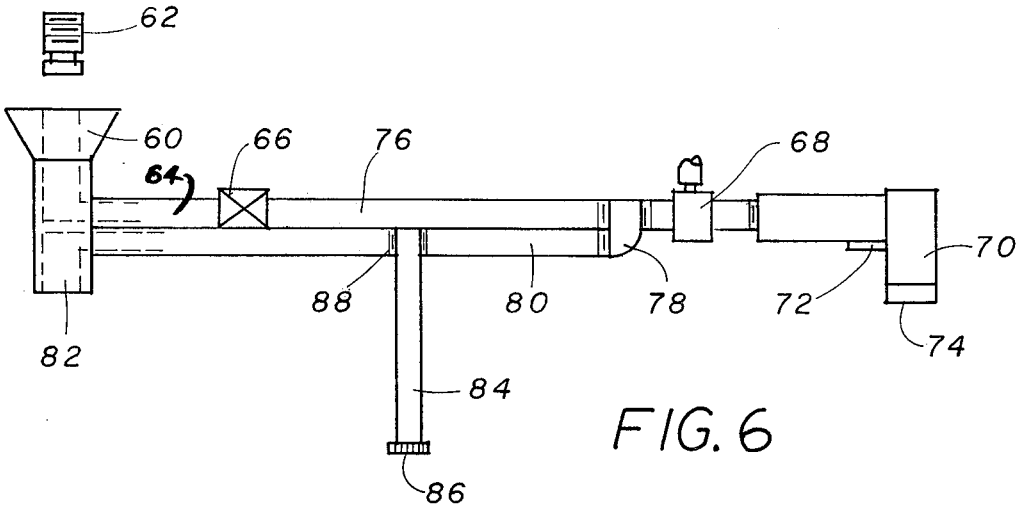
FIG. 6 shown an embodiment of suitable spray and drainage apparatus.

Although there has been described to this point the basic bathtub apparatus or container for bathing a bedridden patient, it will be appreciated that in hospitals, nursing homes and the like, great care must be taken with respect to the hospital water sewage disposal systems, etc. Referring now to FIG. 6, there is shown a particularly suitable water source and suction drain system. As shown in FIG. 6, there is provided a receiving member 60 which may selectively be connected to the outlet end 62 of a faucet. Outlet end 62 may simply be provided by exchanging the normal aerator of a faucet with one suitable for coupling. During the process of supplying water to the bedridden patient or bathtub, the water flows through faucet 62, flows through the passage way 64, past vacuum breaker 66 aspirator 68 and to the spray nozzle 70. Vacuum breaker 66 is basically a one-way check valve to prevent any water in the bathtub or other liquids that might be dispensed from aspirator 68 and 88 from being sucked back into the water system through faucet 62. Such backward flow of water might occur in the event the complete water system of the hospital or a nursing home failed. Thus, it will be appreciated that the vacuum created by the failure of the water system could conceivably draw water back up through the spray head 70, and on into faucet 62.

To produce the spray, the operator simply pulls the spray trigger 72 and water spray emerges from end 74 of spray head 70. In many instances and for certain treatments, it is often desirable to provide certain medications, oils, salves or other materials with the water spray. Accordingly, aspirator 68 provides for the slow addition of such material into the water stream. During the course of a complete bath, a great deal of water may be provided to the portable bathtub, and it will be appreciated that there immediately arises a water disposal problem. As will be discussed hereinafter with respect to FIG. 7, it is possible to provide a simple drain valve at a low point of depression 32 of the inflatable bathtub. However, such a system is often very inconvenient and requires the carrying of large amounts of waste water to a drain point. In addition, it will be appreciated that the cost of producing a pliable sheet 14 having a drain aperture will be significantly increased over the simple pliable sheet such as shown in FIG. 5. Therefore, the apparatus of FIG. 6 also includes the capability of providing suction drainage. According to this suction drainage system in one embodiment, water pathway 76 between vacuum breaker 66 and aspirator 68 includes a control valve 78. Thus, when drainage of the bathtub is desired, control valve 78 is operated such that the water flow is through faucet 62, through vacuum breaker 66 around control valve 78 and into waste water pipe 80. This causes waste water to return to the area of the faucet so that it can be disposed of into the sink through outlet 82 where faucet 62 is located. As the fresh water flows past suction or aspirator tube 84, the VENTURI effect draws up the dirty or used water through end 86 of tube 84. This waste water enters the stainless steel or other suitable material "T" section 88 and passes through outlet 82. Thus, it will be appreciated that all of the water in a portable bathtub may be removed in this manner.

While the embodiment illustrated in FIG. 5 discloses a valve 78, in certain applications this valve can be eliminated such that there is a direct connection between the proximate ends of tube 76 and tube 80. It will be recognized that when the trigger 72 is actuated water will flow through the spray head in the system without the valve 78. When the trigger is not actuated, the water is deadheaded and directed into tube 80 begins to aspirate the water from the tub.

Figure 7:
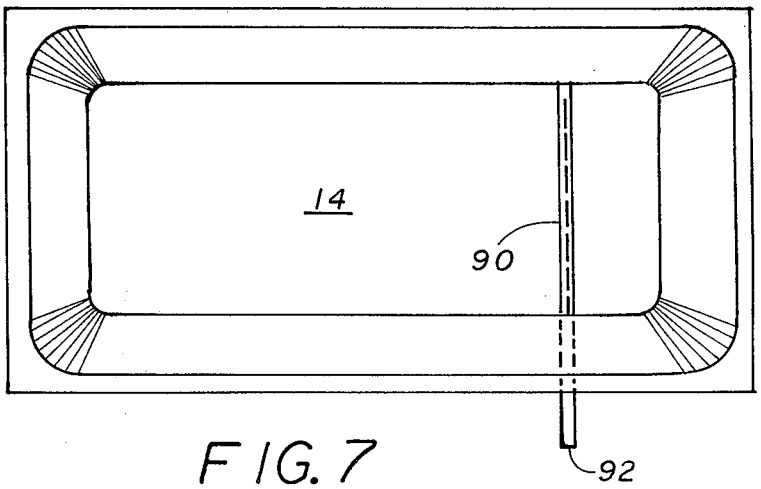
FIG. 7 shows the embodiment of the tub of FIG. 1 having alternate drainage provisions.

However, it will also be appreciated that such a suction drainage system may not always be desirable. Thus, as is shown in FIG. 7, pliable sheet 14 may include a depression 90 to collect the waste water which then flows to a drained hose 92 to a collection point.

The present bathtub can be supported by the bed of a patient and includes a drainage or suction system which is designed to continuously remove water from the linear such that there is a minimal accumulation of water therein. Accordingly, the effective tub weight does not increase substantially during operation. It will, however be recognized that the suction or drainage system can be disabled or used in such a manner that there is an accumulation of water within the tub, if it is derived to emerse a patient.

While there have been described what are at present considered to be preferred embodiments of this invention, it will be obvious to those skilled in the art that various changes and modifications may be made therein without departing from the invention and it is therefore intended to cover all such changes and modifications as fall within the true spirit and scope of the invention.

I claim:

1. An inflatable portable bathtub suitable for bathing a bedridden patient in traction as the patient remains in bed, comprising:

a water impervious and pliable sheet member, said sheet member suitable for moving under said bedrideen patient as said patient remains in bed and in traction;

a linear inflatable open bottomed rim member having a first and further end and a top portion, said rim member suitable for locating on said bed and being sufficiently deformable for curving around and surrounding said bedridden patient such that said first and further ends are proximate each other, and further including joining means for detachably joining said first and further ends; and a multiplicity of attaching means, each of said multiplicity of attaching means including a first portion and a second portion, said first portions selectively located and spaced around the peripheral of said sheet member, and said second portions suitable for cooperating with said first portions and secured to said top portion of said rim member, said second portions being selectively located and spaced along said rim member such that said first portions can be joined to said second portions so that when said rim member is inflated, the peripheral portion of said pliable sheet under said bedridden patient, is raised from the surface of said bed thereby providing a water impervious bathtub containing said bedridden patient.

2. The portable bathtub of claim 1 wherein said first portions of said attaching means are apertures defined by said pliable sheet, and said second portions of said attaching means are hooks suitable for cooperating with said apertures to join said pliable sheet to said rim member.

3. The portable bathtub of claim 1 wherein said pliable sheet is a disposable thin plastic film.

4. The portable bathtub of claim 1, and further including a combination clean water spray and syphon drain means.

5. The portable bathtub of claim 4 wherein said spray means includes a vacuum breaker to prevent waste water from being drawn into said combination.

6. The portable bathtub of claim 4, wherein said combination further includes means for adding materials selected from the group consisting of medications, oils and salves to clean water flowing therethrough.

* * * * *